United States Patent [19]

Goetz

[11] Patent Number: 4,705,226

[45] Date of Patent: Nov. 10, 1987

[54] DEVICE FOR AUTOMATICALLY SPLICING A WEB OF MATERIAL IN A WEB FEEDING APPARATUS

[75] Inventor: Willi Goetz, Seeheim, Fed. Rep. of Germany

[73] Assignee: Valmet-Strecker GmbH, Pfungstadt, Fed. Rep. of Germany

[21] Appl. No.: 3,502

[22] Filed: Jan. 15, 1987

[30] Foreign Application Priority Data

Jan. 17, 1986 [DE] Fed. Rep. of Germany ..... 3601296

[51] Int. Cl.[4] ..... B65H 19/29; B65H 19/08

[52] U.S. Cl. ..... 242/56 R; 156/504

[58] Field of Search ..... 242/58.1, 58.3, 56 R, 242/58.4–58.6; 156/502, 504, 446, 459

[56] References Cited

U.S. PATENT DOCUMENTS

| | | | |
|---|---|---|---|
| 3,756,526 | 9/1973 | Bassett et al. | 242/56 R |
| 4,344,605 | 8/1982 | Gensever et al. | 242/56 R |
| 4,422,588 | 12/1983 | Nowisch | 242/56 R |
| 4,489,900 | 12/1984 | Morizzo | 242/56 R |
| 4,609,162 | 9/1986 | Kataoka | 242/56 R |

*Primary Examiner*—Stuart S. Levy
*Assistant Examiner*—Steven du Bois
*Attorney, Agent, or Firm*—Karl F. Milde, Jr.

[57] ABSTRACT

The invention is directed to a device for automatically splicing a web of material in a web feeding apparatus, in which the web of material is drawn from a supply roll and is stopped in order to change the roll. A severing knife, at least one suction member, a pressure-applying member and a pulley member which can travel on the beam, combined with an anvil for the severing knife, are disposed on an arm-like beam which can be swung toward the circumference of the supply roll. The swinging movement of the beam is limited such that it can approach the roll core only up to a certain minimum distance. However, up to that point the pressure-applying member can bear resiliently against the circumference of the supply roll. The swinging movement of the beam and the movement of the pulley member with the anvil on the beam are controlled such that, when the web of material is stopped to change rolls, the beam swings against the old roll, the pulley brings the web of material in front of the suction member, the anvil moves opposite the severing knife and the web is severed. Thereafter the beam and the pulley member with the anvil return to their starting position and, when a new roll has been mounted, the beam swings against this roll so that the pressure-applying member bears against its circumferential surface to join the old web to the new. Finally the beam swings back to its starting position.

11 Claims, 7 Drawing Figures

DEVICE FOR AUTOMATICALLY SPLICING A WEB OF MATERIAL IN A WEB FEEDING APPARATUS

BACKGROUND OF THE INVENTION

The invention relates to a device for the automatically splicing a web of material in web feeding apparatus. More particularly, the invention relates to an automatic splicing device for web feeding apparatus in which a web of material is drawn over at least one guide roller from a web supply roll and is stopped periodically for changing supply rolls.

It is known, in apparatus for feeding a web of material in which the web is pulled from a supply roll, to splice the web onto a new, replacement roll without stopping it. This technique is known as a "flying splice". However, such apparatus is complex and takes up considerable space. For web feeding apparatus with a plurality of successively arranged supply rolls, such as are used for the simultanecus feeding of a plurality of webs of material, such a splicing apparatus is not suitable. On the other hand, a close spacing between the rolls makes it difficult to perform the manual splicing which still today is commonly practiced.

The present invention is intended to provide a solution to the above-noted problem. It is therefore an object of the invention, in web feeding apparatus in which the web of material is stopped for roll changing, to provide a relatively simple and compact splicing apparatus to perform, in an automatic and time-saving manner, at least all those operations which are connected with splicing and which cannot be performed ahead of time outside of the web feeding apparatus.

SUMMARY OF THE INVENTION

This object, as well as other objects which will become apparent in the discussion that follows, are achieved, according to the present invention, by providing an automatic splicing device wherein a severing knife, at least one suction member, a pressure-applying member and a pulley member which can travel on the beam, combined with an anvil for the severing knife, are disposed on an arm-like beam which can be swung toward the circumference of the supply roll. The swinging movement of the beam is limited such that it can approach the roll core only up to a certain minimum distance. However, up to that point the pressure-applying member can bear resiliently against the circumference of the supply roll. The swinging movement of the beam and the movement of the pulley member with the anvil on the beam are controlled such that, when the web of material is stopped to change rolls, the beam swings against the old roll, the pulley brings the web of material in front of the suction member, the anvil moves opposite the severing knife and the web is severed. Thereafter the beam and the pulley member with the anvil return to their starting position and, when a new roll has been mounted, the beam swings against this roll so that the pressure-applying member bears against its circumferential surface to join the old web to the new. Finally, the beam swings back to its starting position.

The beam in question can be compactly mounted in the guide roller frame above the web supply roll so as to swing downwardly onto the roll. By means of the pulley member, the web is brought in front of the suction member so that the latter can hold its cut end when the web is cut by the severing knife. Then the beam frees the space underneath the guide roller frame for the changing of the roll. The new web roll can, as usual, be prepared outside of the web feeding apparatus, where it is provided with adhesive or a double-sided adhesive tape at the end of the web, and turned on its axis to the position appropriate for splicing. After the insertion of the new roll, the beam needs only to swing downward and thereby to bring the web end being held by the suction member against the circumference of the new roll where it is pressed by the pressure-applying member at the location of the adhesive and is thus joined to the leading end of the new web. After the beam has been swung back up, the web feeding apparatus is ready to run again.

The above-named automatic operations can be performed in a very short time. In fact, if it is important, the rotational orientation of the new roll can be included in the automatic operations.

For a full understanding of the present invention, reference should now be made to the following detailed description of the preferred embodiments of the invention and to the accompanying drawings.

DETAILED DESCRIPTION OF PREFERRED EMBODIMENT

Figure 1:
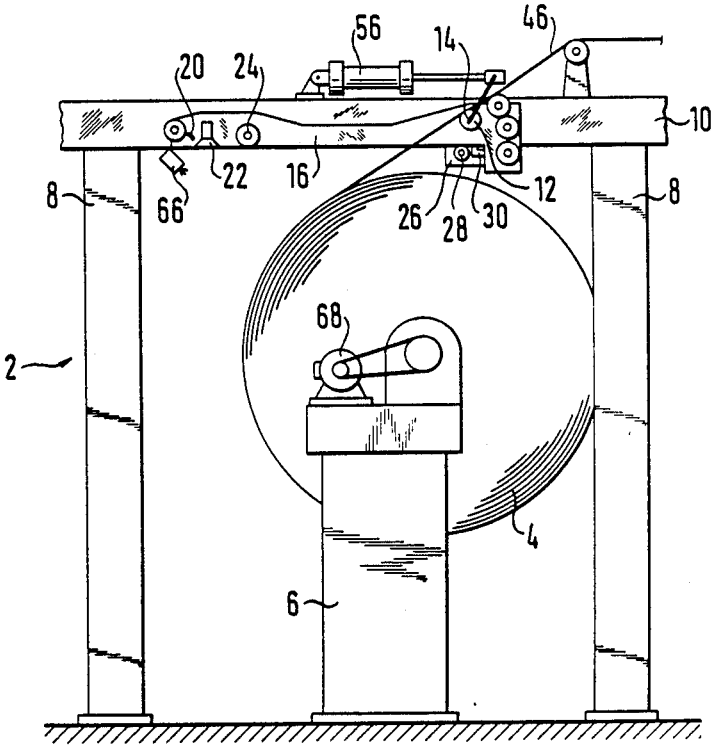
FIG. 1 is a somewhat diagrammatic side view of a web feeding apparatus equipped with the splicing device according to the invention.

The preferred embodiment of the present invention will now be described with reference to FIGS. 1–4*d* of the drawings. Identical elements in the various figures are designated with the same reference numerals.

The web feeding apparatus 2 shown in FIG. 1 has a roll stand 6 that receives the web supply roll 4, and a guide roller frame 10 above it, disposed on columns 8. A beam 16 of the splicing device according to the invention is mounted in the guide roller frame 10 so as to pivot about an axis 14 coinciding with the axis of rotation of a first guide roller 12. The beam 16, which is substantially concealed within the guide roller frame 10 when horizontally disposed in its starting position shown in FIG. 1, can, as will be further described in conjunction with FIG. 4, be swung downwardly against the circumference of the web supply roll 4.

Figure 2:
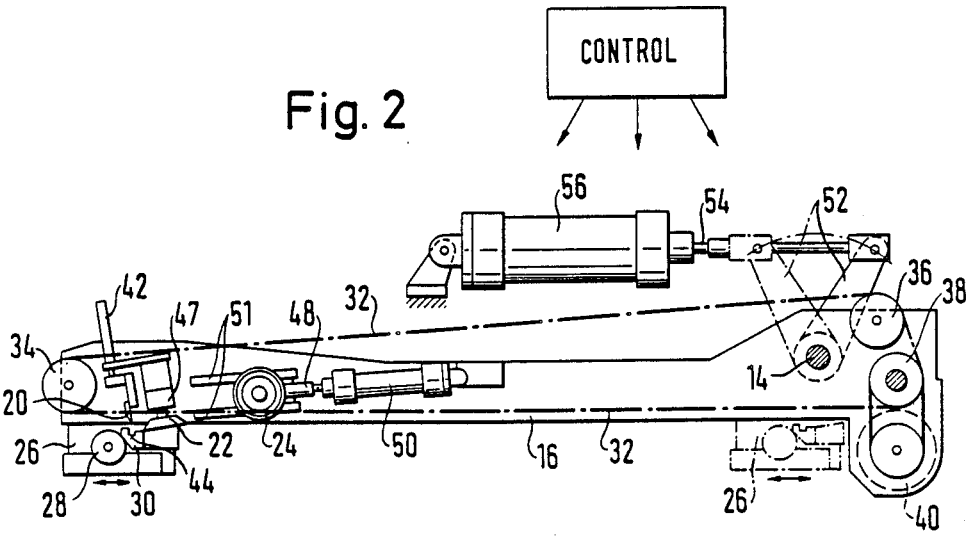
FIG. 2 is a side view of the beam of the splicing device with the component parts provided thereon.
Figure 3:
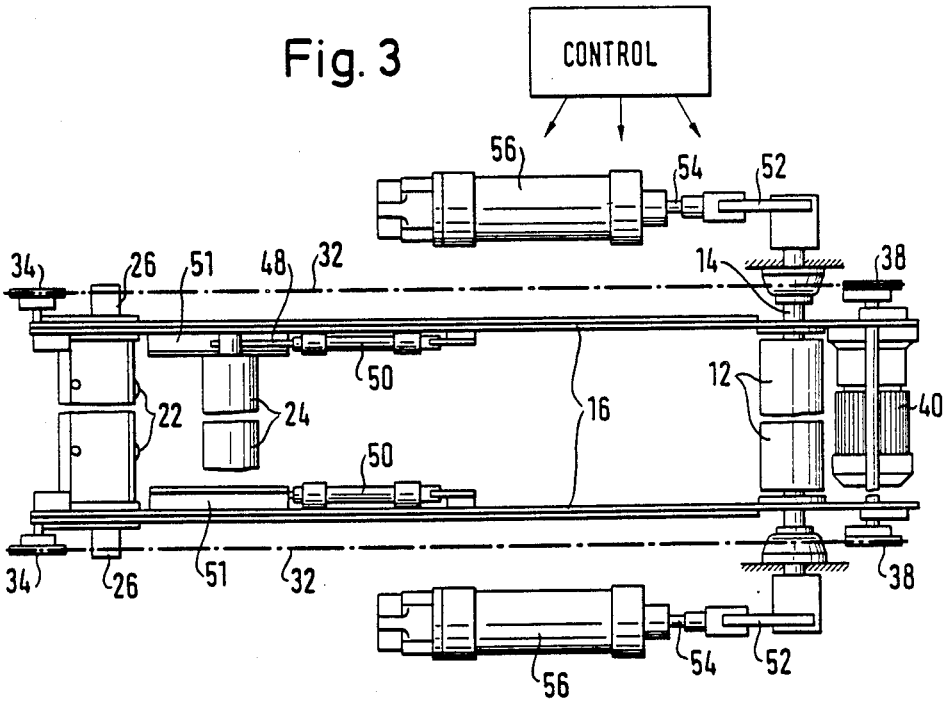
FIG. 3 is a top view of the same beam illustrated in FIG. 2, with its various component parts.

As it is more precisely apparent in FIGS. 2 and 3, a severing knife 20, a transverse row of suction cups 22, a pressure roller 24 and a carriage 26, which supports a roller 28 and a hollow rod 30 forming an anvil for the action of the severing knife 20, and which can travel along the beam 16, are arranged in the order described, beginning from the free end of the beam 16, along the bottom thereof. The rollers 12, 24 and 28, the severing knife 20 and the hollow rod 30 as well as the row of suction cups 22 extend over the entire width of the web of material 46.

The carrier 26, which is shown in FIG. 2 in broken lines in its starting position, and in solid lines in its active position, is coupled on both sides of the beam 16 by roller chains 32 which are carried on sprockets 34, 36 and 38 and can be driven by a motor 40. The severing knife 20 can be lowered by means of pneumatic cylinders 42 into the cavity 44 of the hollow rod 30. In this manner, the web of material 46 running over the roller 28 between the severing knife 20 and the hollow rod 30 can be severed, while the cut end of the web 46 can be held by the suction cups 22. The suction cups 22 receive the vacuum required for their sucking action from a compressed air injector 47 to which the compressed air is fed during the required period of time. The stream of compressed air creates a suction in the injector 47 in a manner well known in the art.

The pressure roller 24 is mounted on the piston rods 48 of pneumatic cylinders 50 on both sides, and by means of these can be reciprocated back and forth essentially along the beam 16. The beam 16 is affixed to the shaft 14 forming the axle for roller 12. Likewise affixed to the shaft 14 are levers 52 on both sides, which are engaged by the piston rods 54 of two pneumatic cylinders mounted in the guide roller frame 10. In this manner the beam 16 can be swung alternately upward and downward by supplying compressed air to the pneumatic cylinders 56.

The gear motor 40 and the pneumatic cylinders 50 and 56 are all controlled by a central control means 68 such that, in conjunction with a roll change operation in the web feeding apparatus 2, the splicer 18 represented in FIG. 4 operates in the manner described below:

FIGS. 4*a*, 4*b*, 4*c* and 4*d* represent the successive phases of operation of the web feeding apparatus according to the invention. Whereas conditions at the beginning of an unwinding action are indicated in broken lines in FIG. 4*a*, the conditions that prevail when the supply of the web runs out are indicated in solid lines, as the roll diameter diminishes to virtually the diameter of the core of the supply roll 4. As it can be seen, the beam 16 assumes its horizontal starting position while the web is being fed and the web 46 runs directly over the first guide roller 12.

Figure 4D:
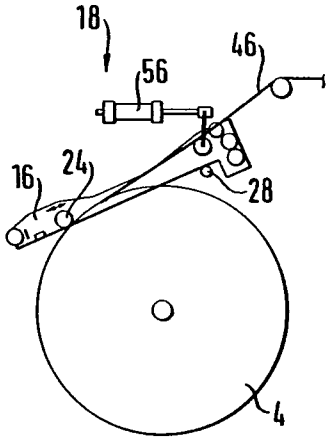
FIGS. 4*a*, 4*b*, 4*c* and 4*d* are representational diagrams of successive phases of the operation of the splicing device according to the invention of the web feeding apparatus of FIG. 1.
Figure 4C:
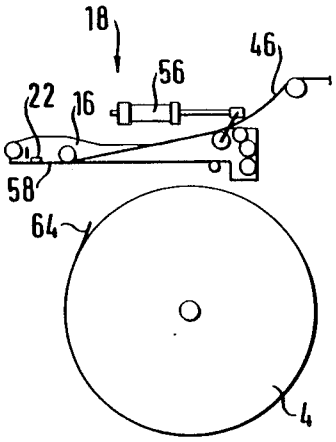
Figure 4B:
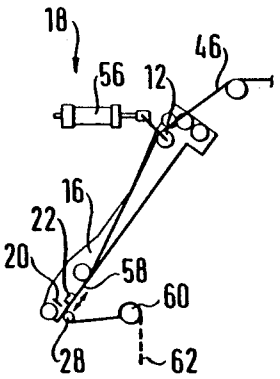
Figure 4A:
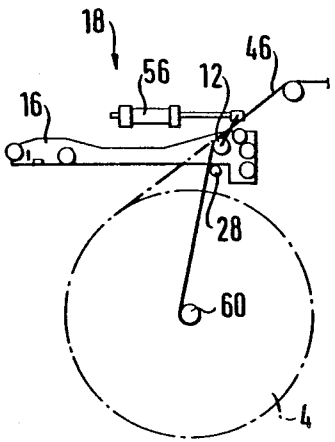

FIG. 4*b* represents the phase in which the splicing apparatus 18 according to the invention has gone into action so as to sever the now stopped web of material 46 and grasp, with the suction cups 22, the rearward end 57 of the piece of material in the guide roller frame. At the same time the beam 16 is swung downward to a position corresponding to the piston end position in the cylinder 56, and the carriage 26 (FIG. 2) has brought the pulley roller 28 close to the free end of the beam 16. This causes the web 46 to undergo a deflection, as a result of which it is brought in front of the severing knife 20 and the suction cups 22 directly behind the latter. If the severing knife 20 and the suction cups 22 are then actuated, the web 46 is severed and the cut end 58 of the web is held by means of the suction cups 22, while the web end 62 remaining on the roll core 60 drops downwardly.

Next the beam 16 together with the end 58 of the web returns to its starting position, so that it permits the old roll core 60 to be replaced by a new supply roll 4; this is illustrated as already accomplished in FIG. 4*c*. The new supply roll 4 was inserted in such a position that the leading end 64 of the web is located at a point suitable for the action of the splicing apparatus 18. Before the new supply roll 4 was inserted, adhesive, or preferably a double-sided adhesive tape, was applied to the leading end 64 of the web.

In FIG. 4*c* the beam 16 is represented as again swung downwardly, while the carrier 26 (FIG. 2) with the pulley roll 28 is still in its starting position. The pressure roll 24 has come to bear against the roll circumference at the leading end 64 of the web, so that it pressed the cut end 58, which is still held by the suction cups 22, against the leading end 64 of the web. Simultaneously, the pneumatic cylinders 50 (FIGS. 2 and 3) are actuated in order to impart a reciprocating motion to the pressure roller 24. In this manner the cut end 58 is rolled against the adhesive onto the leading end 64 of the web, so as to produce a reliable bond.

If the beam 16 now returns to its horizontal starting position, it is possible to resume feeding the web from the new supply roll 4.

The entire splicing operation described above takes but very little time. FIG. 4 furthermore indicates how closely together the successive unwinding stations of a multiple-web feeding apparatus can be disposed, since it is no longer necessary for a worker to pass between them. In particular, FIGS. 4*a*, 4*b*, 4*c* and 4*d* may be viewed as four successive unwinding stations of a single multiple web feeding apparatus, arranged in their respective relative positions.

Since the preparation of the supply rolls 4, including their rotation to the correct position and the application of the adhesive or adhesive strip, can be performed outside of the feeding system 2, there is generally enough time available for the manual performance of these tasks in the conventional manner. If, however, there is need for still further automation, the splicing apparatus 18 according to, the invention can, as indicated in FIG. 1, be supplemented in a simple manner by the automatic rotary positioning of the roll within the feeding device. In this case the unwinding station also has a roll turning device 68 controlled by a sensor 66. The sensor 66 detects the leading end of the web 64 optically or mechanically, for example.

There has thus been shown and described a novel device for automatically splicing a web of material in web feeding apparatus which fulfills all the objects and advantages sought therefor. Many changes, modifications, variations and other uses and applications of the subject invention will, however, become apparent to those skilled in the art after considering this application and the accompanying drawings which disclose the preferred embodiment thereof. All such changes, modifications, variations and other uses and applications which do not depart from the spirit and scope of the invention are deemed to be covered by the invention which is limited only by the claims which follow.

What is claimed is:

1. A device for automatically splicing a web of material in web feeding apparatus in which the web of material is drawn over at least one guide roller from a web supply roll and is stopped periodically for changing supply rolls, said automatic splicing device comprising, in combination:

(a) an arm-like beam having a pivot axis at one end disposed adjacent said guide roller of the web feeding apparatus, said beam being arranged to swing about said pivot axis toward and away from the outer circumference of said supply roll, the swinging movement of said beam being limited such that it can approach the core of said supply roll only up to a certain minimum distance therefrom;

(b) a severing knife, at least one suction means and a pressure-applying means disposed successively from the opposite end of said arm-like beam and extending over substantially the entire width of the web of material, said pressure applying means being capable, until the movement of said beam is limited, of coming resiliently into engagement with the circumferential surface of said roll;

(c) a pulley member and a counter member for said severing knife, disposed on said beam and arranged to travel automatically on said beam perpendicular to said pivot axis, said pulley member and said counter member likewise occupying substantially the entire width of the web of material;

(d) means for controlling the swinging movement of said beam and the movement of said pulley member with said counter-member on said beam such that, (1) with the outrunning web stopped, said beam swings toward the supply roll, said pulley member guides the web in front of said suction member, and said counter-member comes against the severing knife to sever the web; (2) whereupon said beam swings back to its starting position and said pulley member with said counter-member also returns to its starting position; whereupon (3) after a new web supply roll has been installed on the feeding apparatus, said beam swings against the new roll so that said pressure-applying means rests against the circumferential surface of the roll; and, ultimately, (4) said beam swings back again to its starting position.

2. The automatic splicing device according to claim 1, wherein said pulley member comprises a roller.

3. The automatic splicing device according to claim 1, wherein said pressure-applying member comprises a roller.

4. The automatic splicing device according to claim 1, further comprising means for moving said pressure applying member back and forth substantially perpendicularly to the pivot axis of said beam.

5. The automatic splicing device according to claim 1, further comprising means for moving said severing knife and said counter-member against one another perpendicular to the plane of the web of material running between them.

6. The automatic splicing device according to claim 5, wherein said severing knife comprises a knife rail and said counter-member comprises a hollow anvil adapted to receive the cutting edge of the knife rail into itself.

7. The automatic splicing device according to claim 6, wherein said counter-member is made of a moderately hard material such as wood or plastic.

8. The automatic splicing device according to claim 1, wherein said suction member comprises a plurality of suction cups arranged one next to the other.

9. The automatic splicing device according to claim 1, further comprising a compressed air injector to produce the vacuum for said suction member.

10. The automatic splicing device according to claim 1, wherein the pivot axis of said beam coincides with the axis of said first guide roller.

11. The automatic splicing device according to claim 1, further comprising a sensing device for sensing the leading end of the web of material or a prepared adhesive placed on a newly mounted supply roll, and drive apparatus responsive to said sensing device for rotating this supply roll to the position suitable for effective contact with said pressure-applying member.

* * * * *